US007028664B2

(12) United States Patent
Wolf

(10) Patent No.: US 7,028,664 B2
(45) Date of Patent: Apr. 18, 2006

(54) MOTORBRAKE FOR AN INTERNAL COMBUSTION ENGINE

(75) Inventor: Harry Wolf, Uhingen (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/977,105

(22) Filed: Oct. 29, 2004

(65) Prior Publication Data

US 2005/0098150 A1 May 12, 2005

(30) Foreign Application Priority Data

Oct. 31, 2003 (DE) ..... 103 50 925

(51) Int. Cl.
*F02D 13/04* (2006.01)

(52) U.S. Cl. ..... 123/321

(58) Field of Classification Search ..... 123/320–322, 123/90.12, 90.13, 90.16, 90.46, 90.55, 90.56, 123/90.57, 90.58, 90.59, 90.43, 182.1
See application file for complete search history.

(56) References Cited

U.S. PATENT DOCUMENTS

| | | | | |
|---|---|---|---|---|
| 4,930,463 | A * | 6/1990 | Hare, Sr. | 123/182.1 |
| 5,163,389 | A * | 11/1992 | Fujikawa et al. | 123/90.16 |
| 6,032,643 | A * | 3/2000 | Hosaka et al. | 123/321 |
| 6,450,144 | B1 * | 9/2002 | Janak et al. | 123/321 |
| 2003/0101965 | A1 * | 6/2003 | Funke et al. | 123/321 |

FOREIGN PATENT DOCUMENTS

| | | |
|---|---|---|
| DE | 39 22 884 | 5/1992 |

* cited by examiner

*Primary Examiner*—Willis R. Wolfe, Jr.
(74) *Attorney, Agent, or Firm*—Klaus J. Bach

(57) ABSTRACT

In a motor brake for an internal combustion engine having an exhaust valve and an operating mechanism for opening and closing the exhaust valve, the operating mechanism includes a support structure which is firmly connected to, or part of, the internal combustion engine and a pressure element and a valve opening element are movably supported by the support structure so as to transfer a valve opening force to the exhaust valve and a stop structure is provided on the support structure for engaging and supporting the pressure element when the exhaust valve is in the normally closed position or opened for engine braking operation.

12 Claims, 1 Drawing Sheet

MOTORBRAKE FOR AN INTERNAL COMBUSTION ENGINE

BACKGROUND OF THE INVENTION

The invention resides in a motor brake for an internal combustion engine which includes an operating mechanism for an exhaust valve of the engine.

For the deceleration of a vehicle operated by an internal combustion engine often motor brakes are used in addition to the normal vehicle brakes. To this end, the exhaust gas system of the internal combustion engine includes a throttle valve by means of which the exhaust gas backpressure in the exhaust system can be increased when desired. The increased exhaust gas back pressure is effective, by way of the open exhaust valves on the pistons of the engine so as to brake the engine.

In order to achieve a good braking effect, the operating mechanism for the exhaust valves of an internal combustion engine may open the valves at times different from those provided by the camshaft of the engine. During braking operation, the exhaust valves are kept at least partially open for periods adapted to the braking operation, such that communication between the exhaust system and the cylinders is provided which generates in the cylinders a high backpressure effective on the pistons so as to provide for engine braking.

DE 39 22 884 discloses a motor brake for an engine with a camshaft disposed below the hydraulic valve lifters and push rods extending upwardly from the valve lifters. The hydraulic valve lifters include a central bore in which a hydraulic piston is disposed by way of which the exhaust valve can be opened when, during braking operation, hydraulic fluid under pressure is supplied to the valve lifters.

However, in this arrangement, it is disadvantageous that, upon lifting of the valve lifter by the camshaft the hydraulic piston and, together therewith the push rod is also raised unless expensive counter measures are employed. The uncoupling of the camshaft-based opening of the valve from its opening for the purpose of motor braking is difficult. During motor braking operation, the hydraulic pressure effective on the hydraulic piston is also effective—in opposite direction—on the lifter which, therefore is biased against the camshaft resulting in wear of the camshaft.

It is the object of the present invention to provide a motor brake with an operating arrangement for an exhaust valve which can be actuated in a simple manner with respect to the different operating parameters and which results only in relatively little mechanical loads.

SUMMARY OF THE INVENTION

In a motor brake for an internal combustion engine having an exhaust valve and an operating mechanism for opening and closing the exhaust valve, the operating mechanism includes a support structure which is firmly connected to, or part of, the internal combustion engine and a pressure element and a valve opening element are movably supported by the support structure so as to transfer a valve opening force to the exhaust valve and a stop structure is provided on the support structure for engaging and supporting the pressure element when the exhaust valve is not opened by the camshaft.

With the separate supports for the different operating mechanisms the normal opening procedure for the valve by the camshaft can be easily uncoupled from the opening of the valve by the engine braking mechanism. Undesirable relative reactions can be eliminated or limited by simple means.

In an advantageous embodiment, the opening element is supported by the pressure element and the pressure element is supported by a stop on the support structure for the pressure element. Upon actuation of the opening element for opening the exhaust valve during engine braking operation, the actuating force is effective on the pressure element. The actuating reaction force is therefore effective on the stop, not on the camshaft, the rocker or any other element of the valve drive. The camshaft drive mechanism is therefore not subjected to stresses when the valve is opened for braking operations.

For the adjustment of the system, expediently an arrangement is provided wherein the stop is provided with an adjustment device, particularly an adjustment screw. The pressure element and the opening element are adjustable in the axial position with simple means.

In an advantageous manner, the drive support structure is in the form of a hydraulic cylinder, the opening element is a hydraulic piston and the pressure element is a counter piston disposed in the hydraulic cylinder opposite the hydraulic piston so that a hydraulic pressure space is formed in the hydraulic cylinder between the hydraulic piston and the counter piston. With little space requirements, a piston force can be generated by a hydraulic pressure in the pressure space by which the exhaust valve can be opened during braking operation. Various possibilities are provided for generating various control characteristics.

The hydraulic piston and the counter piston are expediently supported so as to be axially movable relative to each other with a lug extending from one and being received in a bore formed in the other of the hydraulic piston and the counter piston. The hydraulic piston and the counter piston may be short in axial direction without a danger of tilting in the hydraulic cylinder. The arrangement can therefore be very compact.

For limiting the relative axial movement between the hydraulic piston and the counter piston, it is expedient to provide upper and lower end stops between the pistons. The relative movement between the hydraulic piston and the counter piston is independent of the movement of the exhaust valve and the rest of the valve drive. A simple and compact arrangement is achieved in providing stops effective on the guide stub between the hydraulic piston and the counter piston.

In another advantageous embodiment, a hydraulic closure relief channel which can be closed by a valve is in communication with the pressure space the valve being closed in a seated rest position of the counter position but being open when the counter piston is unseated. In the rest position of the counter piston, a hydraulic pressure can be built up in the pressure space whereby the exhaust valve can be opened by the hydraulic piston for obtaining the desired braking effect. When the valve is to be opened by the rotating camshaft in accordance with the cyclical normal opening times, the counter piston is moved by the valve operating mechanism out of its rest position. As a result, the pressure relief channel is opened whereby the pressure built up in the pressure space for opening the valve to cause engine braking collapses. The counter piston then approaches the hydraulic piston whereby an uncoupling between the camshaft-based and the engine-braking based valve opening is provided. With further movement of the counter piston, the hydraulic piston is moved further into opening direction of the exhaust valve whereby the exhaust valve is opened beyond the halfway open position it assumes during motor braking.

In a simple design, the relief channel extends through the counter piston and, at its outer, end forms together with the stop structure the channel valve. In this design, the outer end of the relief channel sealing abuts the stop structure, specifically the adjustment screw mounted into the stop structure. In this way, an effective valve is provided without additional components which, alone by the camshaft caused displacement of the counter piston opens and closes the relief channel in the way desired.

Expediently, a hydraulic fluid supply passage extends to the hydraulic fluid chamber from one side thereof such that its opening into the hydraulic fluid chamber is so arranged in the axial direction of the hydraulic cylinder that it is closed by the hydraulic piston when the hydraulic piston is moved out of its rest position. During motor braking operation, a hydraulic pressure may be maintained in the fluid supply passage for opening the valve over a comparatively long period. With a camshaft-based operation of the counter piston, the supply passage is closed without the need for decreasing the hydraulic fluid supply pressure for the camshaft-based valve opening period. The hydraulic fluid can be released from the pressure space through the relief channel while no additional hydraulic fluid enters the pressure space that is no pressure is built up in the pressure space.

In an advantageous further embodiment, the hydraulic fluid is simply motor oil. No separate hydraulic fluid system is needed. The motor oil leaving through the relief channel can simply be returned to the engine oil circuit.

For a compact design, it is expedient if the drive mechanism with the pressure element and the opening element are so arranged that they act directly on the exhaust valve.

A particular embodiment of the invention will be described below in greater detail on the basis of the accompanying drawings.

DESCRIPTION OF A PARTICULAR EMBODIMENT

Figure 1:
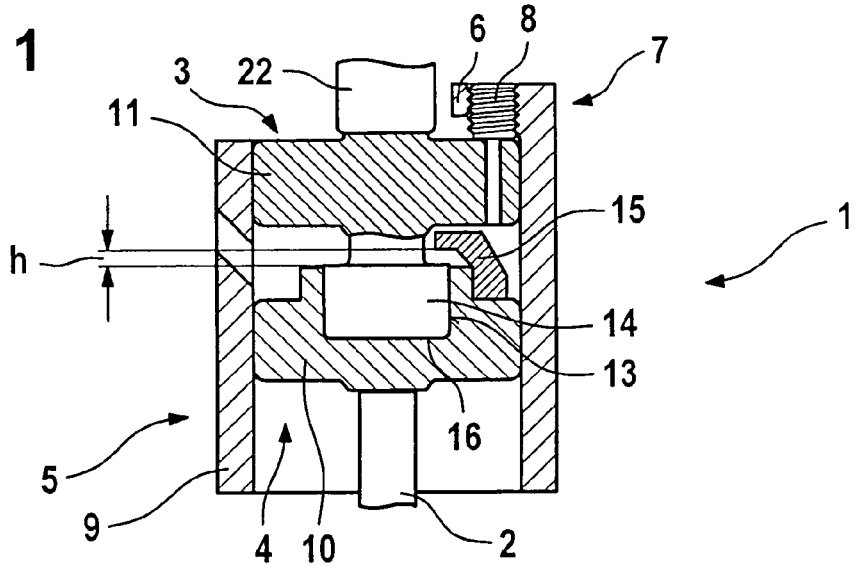
FIG. 1 shows in a schematic cross-sectional view, a valve operating arrangement for a motor brake with a hydraulic cylinder, a hydraulic piston and a counter piston in a rest position.

FIG. 1 shows schematically, in a cross-sectional view, an operating structure 1 for an exhaust valve 2 of an internal combustion engine with a motor brake. By way of the operating structure 1, the exhaust valve 2, which is schematically represented by the valve shaft, is operable in normal engine operation as well as in motor brake operation.

The operating structure 1 includes a pressure element 3 which acts on the exhaust valve 2 and an opening element 4 disposed between the pressure element 3 and the exhaust valve 2. The pressure element 3 and the opening element 4 are separately guided in a drive carrier 5 which is firmly connected to, or part of, the engine.

In the embodiment shown, the drive carrier 5 is shown as a hydraulic cylinder 9, the opening element 4 as a hydraulic piston 10 and the pressure element 3 as a counter piston 11 arranged opposite to the hydraulic piston 10. The counter piston 11 is provided at its end facing the hydraulic piston 10 with a lug 14, which is received in a bore 13 of the hydraulic piston 10 and which in the position shown in FIG. 1, abuts the inner end wall of the bore 13. The hydraulic piston 10 abuts the shaft of the exhaust valve 2.

The operating mechanism comprises a rocker 22, which acts on the counter piston 11 for opening the valve 2. During normal engine operation, the rocker 22 moves the counter piston 11 downwardly from the rest position as shown in FIG. 1. The downward movement of the counter piston 11 is transferred by the lower stop 16 and the hydraulic piston 10 mechanically to the exhaust valve 2 as the counter piston 11 and the hydraulic piston 10 move from the position shown in FIG. 1 to the position shown in FIG. 3.

In the rest position as shown in FIG. 1, the counter piston 11 is supported by a stop 6 of the drive carrier 5. The stop 6 is provided with an adjustment device 7, which, in the embodiment shown, is an adjustment screw 8. The adjustment device may also be a hydraulic adjustment device or a similar structure. By means of the adjustment screw, the rest position of the counter piston 11 in axial direction is adjustable such that the engagement between the counter piston 11 and the rocker is essentially pressure free or there may be even some play. Adjoining the counter piston 11, there may be, in place of the rocker 22, a cam of a camshaft or another valve drive. In place of a direct force transmission from the hydraulic piston 10 to the exhaust valve 2 a pushrod or similar structure may be provided for example in connection with engines with a lower camshaft.

The hydraulic piston 10 and the counter piston 11 are supported in the hydraulic cylinder so as to be movable in axial direction independently from each other. They are additionally guided relative to each other by the lug 14 received in the bore 13. The axial mobility of the hydraulic piston 10 relative to the counter piston 11 is limited at one side by the end wall 16 of the bore 13 and in opposite direction by an upper stop 15. In the embodiment shown, the upper stop 15 is mounted on the hydraulic piston 10 and is in the form of a hook which extends into a groove between the lug 14 and the counter piston 11. The two stops 15, 16 are arranged relative to each other in such a way that the hydraulic piston 10 is movable relative to the counter piston 11 in axial direction by a partial valve stroke length h.

Figure 2:
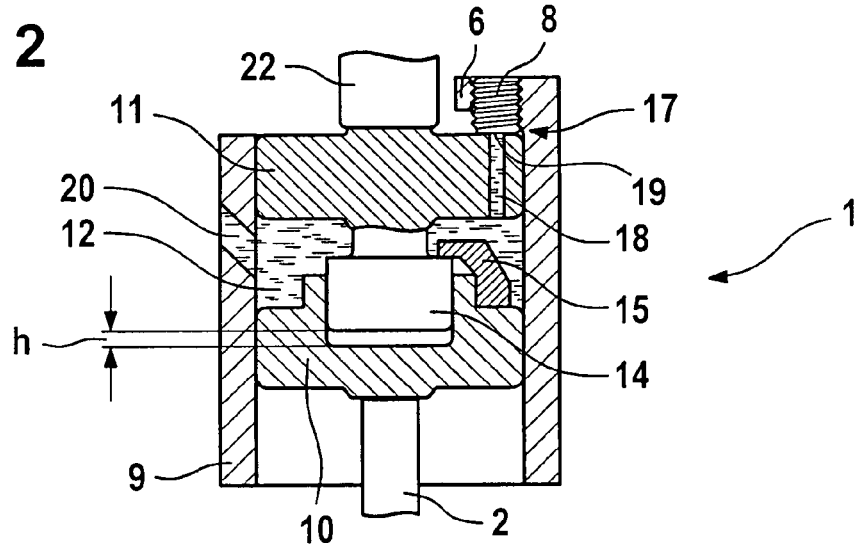
FIG. 2 shows the arrangement of FIG. 1 during motor braking operation wherein the exhaust valve is halfway open.

FIG. 2 shows the arrangement wherein the counter piston 11 is in the position as shown in FIG. 1 in which the exhaust valve is normally closed, that is, not actuated by the camshaft but is partially opened for braking operation of the engine. For partially opening, the valve 2 hydraulic fluid is supplied to the pressure space 12 of the hydraulic cylinder 9 between the hydraulic piston 10 and the counter piston 11 by way of a hydraulic fluid supply passage 20 extending through the wall of the hydraulic cylinder 9 whereby the hydraulic cylinder 10 is moved into valve opening direction until the stop 15 engages the lug 14, that is, by the stroke length h. The counter piston 11 includes a pressurized fluid relief passage 18 which extends axially through the counter piston into the pressure space 12. At its outer end 19, the relief passage 18 is closed by abutment with the stop 6 having an adjustment screw 8 which engages the counter cylinder so as to sealingly close the relief passage 18. The stop 6 or respectively, the adjustment screw 8 form with the outer end 19 of the relief passage 18 a valve 17, which sealingly closes the relief passage 18 in the shown rest position of the counter piston 11.

For pressurizing the pressure space 12 preferably engine oil is supplied to the pressure space 12 through the supply passage 20, whereby the hydraulic piston 10 is moved away from the counter piston 11 by the partial stroke length h until the upper stop 15 engages the lug 14. By this movement of the hydraulic piston 10, the exhaust valve 2 is moved by the partial stroke length h to the partially open position for the engine braking operation. Alternatively, a separate hydraulic fluid pressure supply arrangement may be provided.

The hydraulic piston 10 is supported by way of the pressurized hydraulic fluid in the pressure space 12 on the counter piston 11. However, the counter piston 11 is supported on the stop structure 6 by way of the adjustment screw 8 so that the support pressure is not transmitted to the valve drive, that is, to the rocker 22 shown in the figures.

Figure 3:
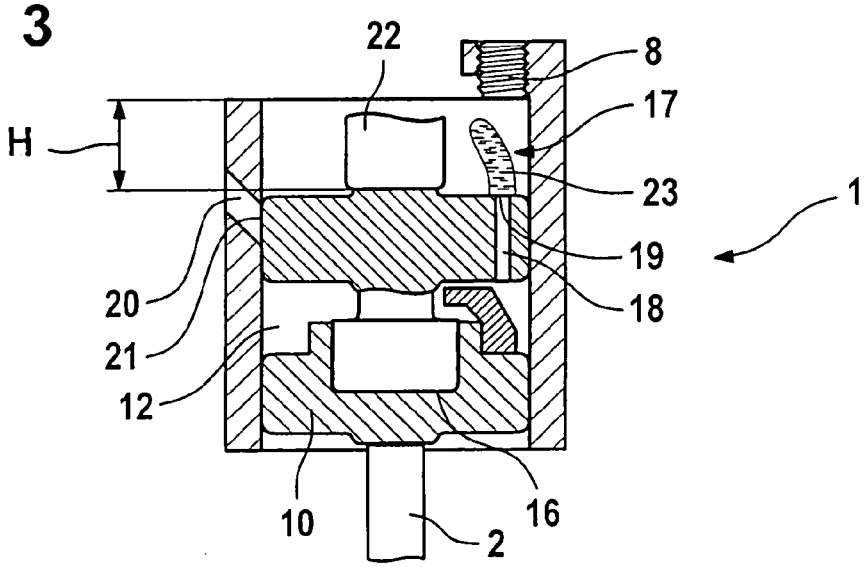
FIG. 3 shows the arrangement according to FIGS. 1 and 2, wherein the exhaust valve is fully opened by a camshaft-based valve opening action.

FIG. 3 shows the arrangement of FIGS. 1 and 2, wherein however the exhaust valve 2 is fully opened by its actuation by the camshaft-actuated valve drive, that is, the rocker 22. The rocker 22 is lowered in this case so far that the counter piston is moved down by the stroke length H. The opening of the supply passage 20 into the hydraulic cylinder 9 is arranged in the hydraulic cylinder 9 at an axial location such that, in the valve opening position of the counter piston 11 as shown in FIG. 3, the opening 21 of the supply passage 20 is closed by the circumferential wall of the counter piston 11. During the valve opening phase of the counter piston 11 as shown in FIG. 3 the hydraulic pressure can be maintained in the supply passage 20.

In the valve opening position of the counter piston 11, the end 19 of the relief passage 18 is spaced from the stop structure 6, or, respectively, the adjustment screw 8 so that the valve 17 is opened. The oil 23 contained in the pressure space 12 can therefore flow out of the pressure space 12 through the relief passage 18 whereby the volume of the pressure space is reduced until the counter piston 11 or respectively, the lug 14 thereof is seated on the end wall 16 of the bore 13 in the hydraulic cylinder 10. The valve opening force generated by the valve operating mechanism is then transmitted directly mechanically from the rocker 22 by way of the counter piston 11, the stub 14, the end wall 16 and the hydraulic piston 10 to the exhaust valve 2. Accordingly, the exhaust valve 2 executes the full opening stroke H like the counter piston 11.

What is claimed is:

1. A motor brake for an internal combustion engine having an exhaust valve (2) and an operating mechanism (1) for opening and closing the exhaust valve (2), said operating mechanism (1) including a support cylinder (5) firmly connected to, or being part of, the internal combustion engine, a pressure piston (11) movably supported in the support cylinder (5) and a valve opening piston (10) also movably supported in the support cylinder (5) between the pressure piston (11) and the exhaust valve (2) for transmitting the valve opening force from the pressure piston (11) to the exhaust valve (2), said hydraulic piston (10) including a bore (16) and the pressure piston (11) including a lug (14) received in the bore of the hydraulic piston (10), said valve opening piston (10) and said pressure piston (11) being supported in the hydraulic cylinder (9) so as to be axially movable relative to each other.

2. A motor brake according to claim 1, wherein the support cylinder (5) with the pressure piston (11) and the valve opening piston (10) are arranged so as to act directly on the exhaust valve (2).

3. A motor brake according to claim 1, wherein, for limiting the relative axial movement of the valve opening piston (10) and the pressure piston (11), upper and lower stops (15, 16) are provided on the pistons.

4. A motor brake according to claim 3, wherein the upper and lower stops (15 ,16) are effective at opposite ends of the stub (14).

5. A motor brake according to claim 1, wherein the valve opening piston (10) is supported against the pressure piston (11) and the pressure piston (11) is supported against a stop structure (6) of the support cylinder (5).

6. A motor brake according to claim 5, wherein the stop structure (6) includes an adjustment device (7) for adjusting the end position of the pressure piston (11).

7. A motor brake according to claim 6, wherein the adjustment device (7) is an adjustment screw (8).

8. A motor brake according to claim 1, wherein the valve opening piston (10) and the pressure piston (11) are disposed adjacent each other so that a pressure space (12) is formed between the hydraulic valve opening piston (10) and the pressure piston (11).

9. A motor brake according to claim 8, wherein a hydraulic pressure relief passage (18) provided with a valve (17) extends from the pressure space (12), and a valve (17) is so arranged that it is closed when the pressure piston (11) is in its rest position in which the exhaust valve (2) is normally closed but that the valve is opened when the pressure piston (11) is moved out of its rest position.

10. A motor brake according to claim 9, wherein the relieve passage (18) extends through the pressure piston (11) such that the stop structure (6) is disposed over the outlet end of the relief passage (18) and closes the relief passage (18) when the pressure piston (11) is in its rest position.

11. A motor brake according to claim 8, wherein a hydraulic fluid supply passage (20) extends through the hydraulic cylinder (19) to the pressure space (12) in the cylinder (9) at a location such that the hydraulic fluid supply passage (20) is closed by the pressure piston (11) when the pressure piston (11) is moved out of its rest position.

12. A motor brake according to claim 11, wherein engine oil is used as a hydraulic fluid in the pressure space (12).

* * * * *